US006490955B2

(12) United States Patent
Chang-Kao et al.

(10) Patent No.: US 6,490,955 B2
(45) Date of Patent: Dec. 10, 2002

(54) SCREWDRIVER SHANK WITH A UNIVERSAL JOINT

(76) Inventors: Chiu-Man Chang-Kao, No. 38-1, Hsiang Nung Hsiang, Hsi Nan Road, Wu Jih, Taichung Hsien (TW); Mei-Chen Wang, No. 536-1, Ta Chin Street, Taichung (TW)

( * ) Notice: Subject to any disclaimer, the term of this patent is extended or adjusted under 35 U.S.C. 154(b) by 0 days.

(21) Appl. No.: 09/835,723

(22) Filed: Apr. 16, 2001

(65) Prior Publication Data

US 2002/0148332 A1 Oct. 17, 2002

(51) Int. Cl.[7] ..... B25B 23/16
(52) U.S. Cl. ..... 81/177.75; 81/177.4; 81/439
(58) Field of Search ..... 81/177.7, 177.75, 81/177.8, 177.9, 177.4, 490, 438, 439

(56) References Cited

U.S. PATENT DOCUMENTS 1,167,948 A * 1/1916 Starrett et al. ..... 81/177.85
1,643,855 A * 9/1927 Peterson ..... 81/177.85
4,065,941 A * 1/1978 Aoki ..... 81/177.75 X
4,936,701 A * 6/1990 Allen et al. ..... 81/177.75 X
4,984,942 A * 1/1991 Holtz ..... 81/177.85 X
5,927,162 A * 7/1999 Huang ..... 81/177.8
6,105,473 A * 8/2000 Huang ..... 81/75

* cited by examiner

*Primary Examiner*—D. S. Meislin
(74) *Attorney, Agent, or Firm*—Alan D. Kamrath; Rider, Bennett, Egan & Arundel

(57) ABSTRACT

A screwdriver includes a handle including a seat, a shank having a first end in universal joint with the seat and a second end engaged with a tool bit, and an elastic element for retaining the first end of the shank and the seat together such that the first end of the shank and the seat rotate together when the handle is turned. The first end of the shank is in the form of a ball. The seat includes a pinhole, the ball of the shank includes a pinhole, and a pin is extended through the pinhole of the seat and the pinhole of the shank. An inner periphery of the ball presses against an inner periphery of the seat.

3 Claims, 5 Drawing Sheets

SCREWDRIVER SHANK WITH A UNIVERSAL JOINT

BACKGROUND OF THE INVENTION

1. Field of the Invention

The present invention relates to a screwdriver shank having a universal joint with a screwdriver handle to allow tightening/loosening of a fastener that cannot be driven at an upright position of the screwdriver.

2. Description of the Related Art

Screwdrivers are useful in daily life. However, it is troublesome, sometimes impossible, to use screwdrivers when the fasteners to be tightened/loosened cannot be driven at an upright position of the screwdrivers. The present invention is intended to provide a screwdriver shank having a universal joint with a screwdriver handle to solve this problem.

SUMMARY OF THE INVENTION

A screwdriver in accordance with the present invention comprises a handle including a seat, a shank having a first end in universal joint with the seat and a second end engaged with a tool bit, and means for retaining the first end of the shank and the seat together such that the first end of the shank and the seat rotate together when the handle is turned.

The first end of the shank is in the form of a ball. The retaining means is an elastic element mounted in the seat. The seat includes a pinhole, the ball of the shank includes a pinhole, and a pin is extended through the pinhole of the seat and the pinhole of the shank. The elastic element biases the ball to press against the pin. An outer periphery of the ball presses against an inner periphery of the seat. The pinhole of the ball is longer than the pinhole of the seat. A sleeve is mounted around the shank and slidable along a longitudinal direction of the shank, the sleeve carrying a plurality of tool bits. The sleeve includes a tubular portion that houses the pin and a portion of the seat. The tubular portion of the sleeve includes a plurality of ribs for frictional contact with an outer periphery of the seat.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
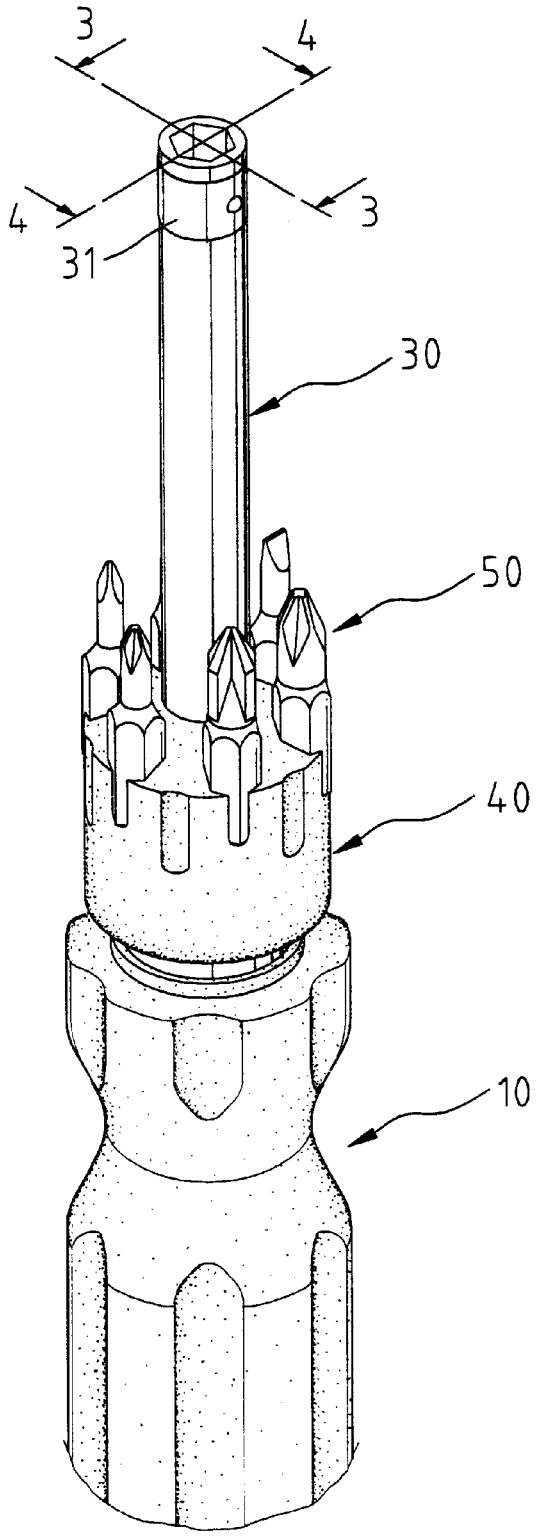
FIG. 1 is a perspective view of a screwdriver in accordance with the present invention.
Figure 2:
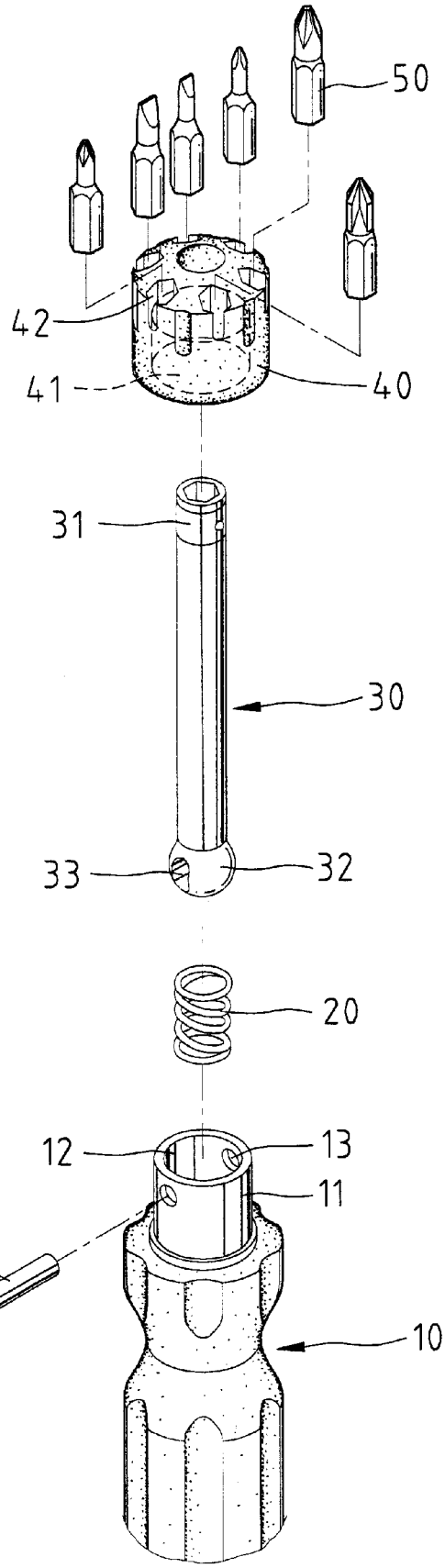
FIG. 2 is an exploded perspective view of the screwdriver in accordance with the present invention.
Figure 3:
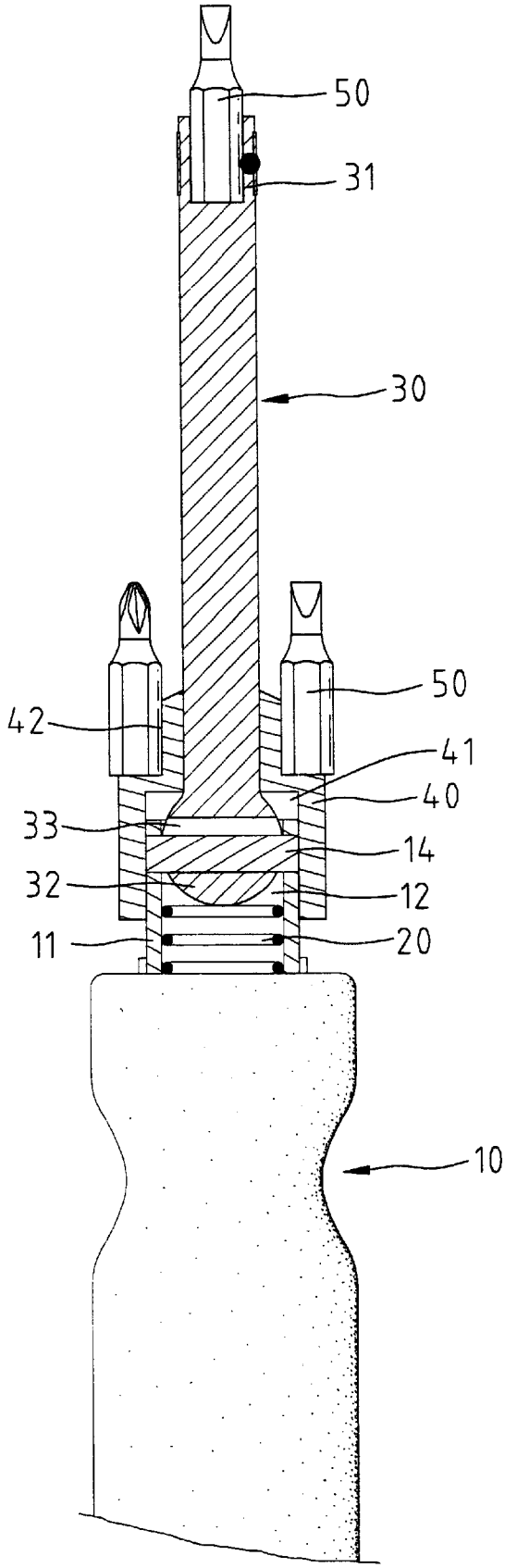
FIG. 3 is a sectional view taken along plane 3—3 in FIG. 1.

A handle 10 includes a first end 32 received in the compartment 12 and a second end 31 for engaging with a tool bit. In this embodiment, the first end 32 is in the form of a ball and includes a pinhole 33. The pinhole 33 is elongated and longer than the pinhole 13 of the seat 11. A pin 14 is extended through the pinhole 13 of the seat 11 and the pinhole 33 of the first end 32, as illustrated in FIG. 3.

A sleeve 40 is mounted around the shank 30 and slidable along a longitudinal direction of tie shank 30. The sleeve 40 includes a tubular portion 41 for housing the pin 14 and a portion of the seat 11. The sleeve 40 many further include a plurality of grooves 42 for receiving various tool bits 50. The tubular portion 41 may include a plurality of ribs to provide increased frictional contact with the outer periphery of the seat 11.

In a normal operating condition, the shank 30 is in an upright position in which the longitudinal axis of the shank 30 coincides with that of the handle 10. The elastic element 20 biases the first end 32 to move upward and thus press against the pin 14, thereby allowing joint rotation of the first end 32 and the seat 11 when the handle 10 is turned. The tubular portion 41 of the sleeve 40 assists in retaining the shank 30 in the upright position. Thus, the user may tar the screwdriver to drive a fastener.

Figure 4:
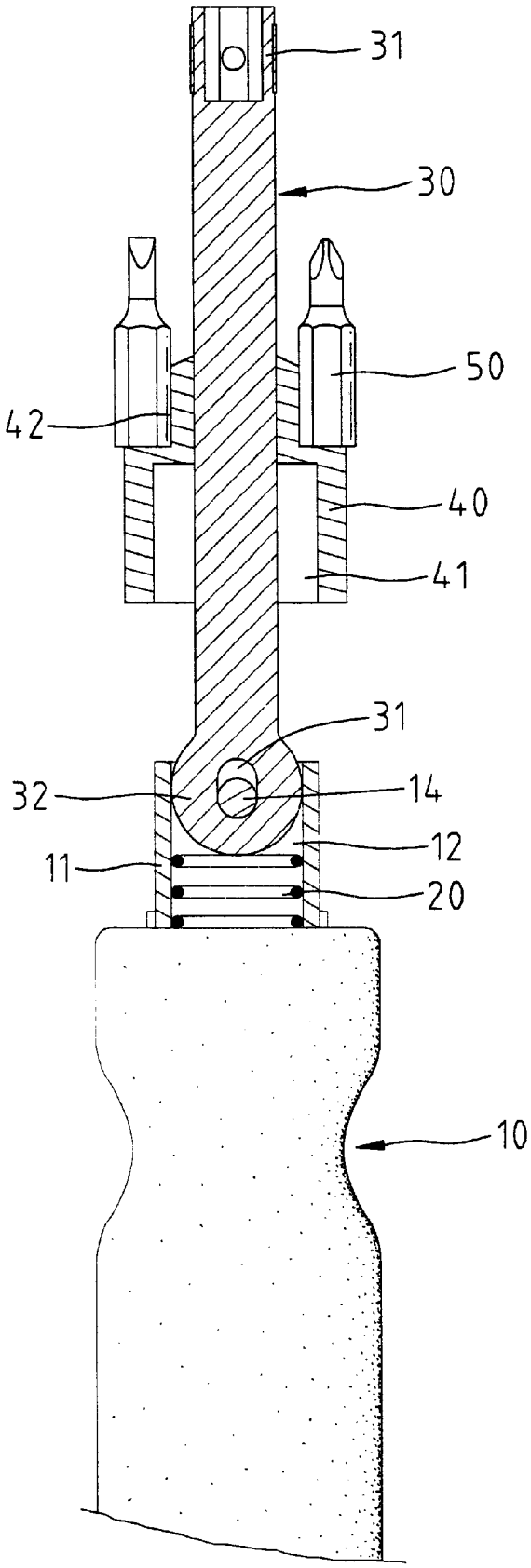
FIG. 4 is a sectional view taken along plane 4—4 in FIG. 1, wherein a sleeve on the shank of the screwdriver is moved.
Figure 5:
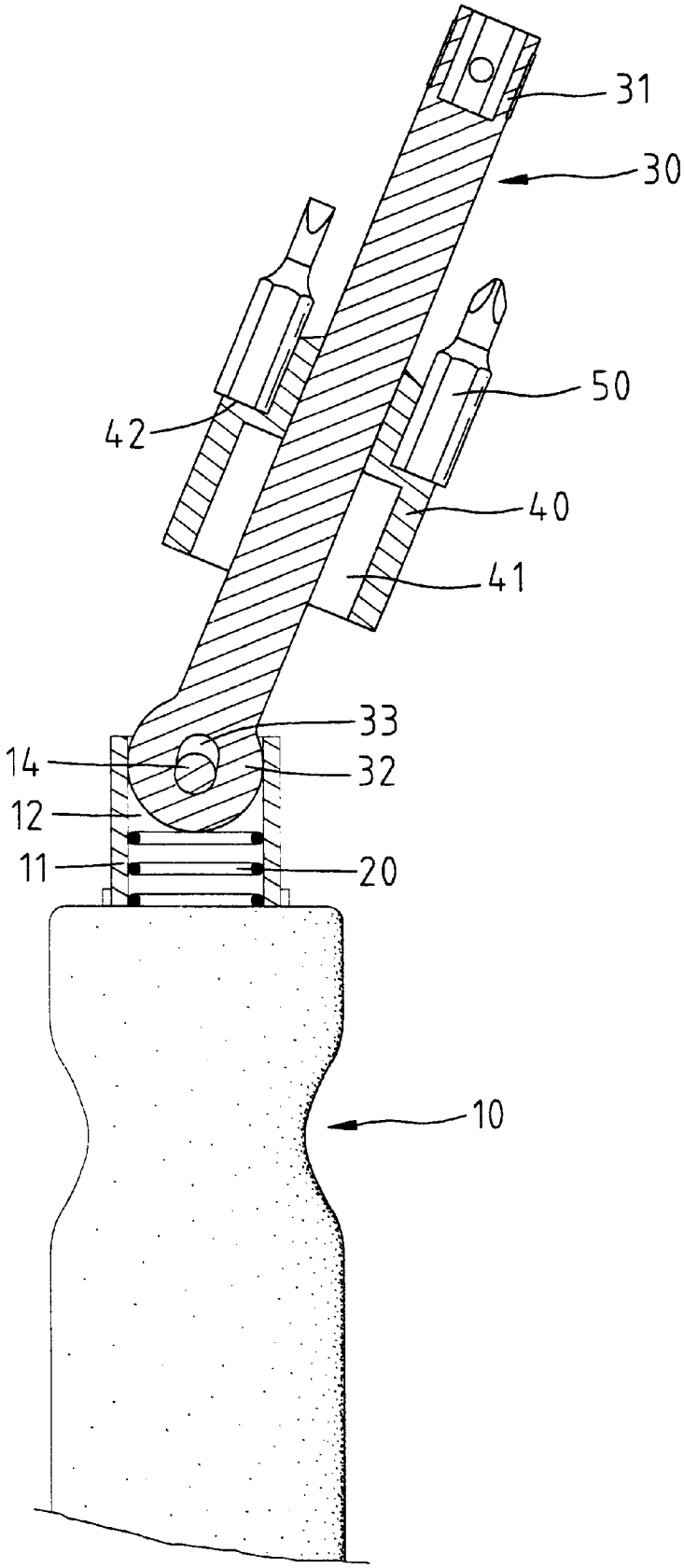
FIG. 5 is a sectional view similar to FIG. 4, wherein the shank is pivoted to a tilt position relative to the handle.

When the fastener to be tightened/loosened is in a place that the screwdriver cannot be used in its upright-position, the user may move the sleeve 40 away from the handle 10 (FIG. 4) and then pivot the shank 30 to a tilt position relative to the handle 10, best shown in FIG. 5. In this tilt position, the longitudinal axis of the shank 30 is at an angle relative to the handle 10. The elastic element 20 biases the first end 32 to move upward and thus press against the pin 14. In addition, the outer periphery of the first end 32 is in frictional contact with the inner periphery of the seat 11. Thus, the first end 32 and the seat 11 rotate together when the handle 10 is turned. As a result, the user may tighten/loosen a fastener that is located in a place in which the screwdriver cannot be used in its upright position. Namely, the screwdriver can be used with its shank in a tilt position.

According to the above description, it is appreciated that the screwdriver in accordance with the present invention provides a shank 30 that is in universal joint with the seat 11 of the handle 10 and thus can be used conveniently.

Although the invention has been explained in relation to its preferred embodiment, it is to be understood that many other possible modifications and variations can be made without departing from the scope of the invention as hereinafter claimed.

What is claimed is:

1. A screwdriver comprising:

a handle including a seat;

a shank having a first end in universal joint with the seat and a second end adapted to engage with a tool bit, wherein the first end of the shank is in the form of a ball;

means for retaining the first end of the shank and the seat together such that the first end of the shank and the seat rotate together when the handle is turned, wherein the retaining means is an elastic element mounted in the seat, wherein the seat includes a pinhole, the ball of the shank including a pinhole, a pin extended through the pinhole of the seat and the pinhole through the shank, wherein the elastic element biases the ball to press against the pin; and a sleeve mounted around the shank and slidable along the longitudinal direction of the shank, wherein the sleeve includes a tubular portion that houses the pin and a portion of the seat, with the sleeve carrying a plurality of tool bits.

2. The screwdriver as claimed in claim 1, wherein the ball includes an outer periphery that presses against an inner periphery of the seat.

3. The screwdriver as claimed in claim 1, wherein the pinhole of the ball is longer than the pinhole of the seat.

* * * * *